United States Patent [19]

Norton et al.

[11] Patent Number: 4,871,308

[45] Date of Patent: Oct. 3, 1989

[54] METHOD AND APPARATUS FOR HEATING A FLUID STREAM

[75] Inventors: John P. Norton; Steven Schneider; William D. Wilder; Stephen J. Hussell, all of Hamilton County, Ohio

[73] Assignees: Combustion Concepts Inc., Detroit, Mich.; Williamson Company, Cincinnati, Ohio

[21] Appl. No.: 125,168

[22] Filed: Nov. 25, 1987

[51] Int. Cl.[4] ..... F24H 1/00

[52] U.S. Cl. ..... 432/29; 432/219; 431/158; 122/20 B

[58] Field of Search ..... 122/20 B, 17, 134; 126/362; 237/56, 1 R; 110/234; 432/219, 29; 431/158, 353, 61

[56] References Cited

U.S. PATENT DOCUMENTS

| | | | |
|---|---|---|---|
| 1,170,834 | 2/1916 | Lovekin | 122/17 |
| 2,725,929 | 12/1955 | Massier | 431/158 |
| 4,014,316 | 3/1977 | Jones et al. | 431/158 |
| 4,120,640 | 6/1984 | Martin . | |
| 4,203,392 | 5/1980 | McLane | 122/134 |
| 4,218,211 | 8/1980 | Caplan | 432/219 |
| 4,372,487 | 2/1983 | Hollister | 122/20 B |
| 4,503,902 | 3/1985 | Zolik . | |
| 4,507,075 | 3/1985 | Buss et al. . | |
| 4,577,615 | 3/1986 | Tomlinson . | |
| 4,669,656 | 6/1987 | Turko . | |

*Primary Examiner*—Henry A. Bennett

*Attorney, Agent, or Firm*—Ralph B. Brick

[57] ABSTRACT

An improved method and apparatus for heating fluids wherein separate gas streams of natural gas and air are compressed to a preselected pressure, passed to an injection and mixing zone for thorough mixing including expansion of one gas and compression of the other, passed to a combustion chamber for burning with the combustion products being further contracted and passed to a heat exchanger conduit where such combustion products are progressively further contracted as they are brought into heat exchange with the fluid to be heated.

50 Claims, 5 Drawing Sheets

METHOD AND APPARATUS FOR HEATING A FLUID STREAM

BACKGROUND OF THE INVENTION

The present invention relates to a method and apparatus for heating a fluid stream and more particularly to a unique and novel method and apparatus for heating a gas or a liquid with compressed combustible fuel gas and compressed gas for supporting the efficient combustion of such fuel gas.

It long has been known to conduct and inject into a combustion burner a fluid combustible fuel through the chamber of a central conduit and to conduct and inject therewith a combustion supporting fluid into the burner through an annular passage defined by another conduit spaced from and surrounding the central conduit. In this regard, attention is directed to long expired U. S. Pat. No. 405,391, issued to P. L. Bear on Jun. 18, 1889, which patent broadly teaches such an arrangement for an oil burner and to long expired U.S. Pat. No. 622,146, issued to G. Heysel on Mar. 28, 1899, which patent broadly teaches another such arrangement for a hydrocarbon burner. Further attention is directed to unexpired U.S. Pat. No. 3,902,840, issued to Paul Baguet on Sept. 2, 1975, which also teaches two coaxial injectors for a fuel gas and combustion supporting gas, this patent further teaching a combustion chamber having a narrowing outlet. In this regard, attention is further directed to expired U.S. Pat. No. 2,652,890, issued to C. W. Morck, Jr., et al on Sept. 22, 1953 and to U.S. Pat. No. 3,424,541, issued to R. Wang, et al on Jan. 28, 1969, both of which teach such a refractory lined combustion chamber, attention being further directed to the coaxial injection apparatus disclosed by the Wang patent. Finally, attention is directed to the coiled heat exchange arrangement of unexpired U.S. Pat. No. 4,161,391, issued to Herbert W. Parker on Jul. 17, 1979 and to the reduced heat exchange tubes taught by expired U.S. Pat. No. 2,182,218, issued to J. C. Woodson on Dec. 5, 1939 and by unexpired U.S. Pat. No. 4,218,211, issued to Stanley Z. Caplan on Aug. 19, 1980. A number of other patents noted as of possible interest relating to the mixing of gases for burning are as follows: U.S. Pat. Nos. 993,687, issued to B. F. Jackson on May 30, 1911; 1,921,059, issued to J. M. Weil, et al on Aug. 8, 1933; 2,340,120, issued to H. L. Grupp on Jan. 25, 1944; 2,526,748, issued to N. E. Hill on Oct. 24, 1950; 2,838,105, issued to D. Eastman, et al on Jun. 10, 1958; and 3,074,469, issued to R. P. Babbitt, et al on Jan. 22, 1963.

Although a number of these several aforementioned patents might each broadly and separately have suggested coaxial injection apparatus, refractory lined combustion chamber apparatus narrowing at the outlet end thereof, coiled heat exchange tubes and heat exchange change tubes narrowing at the outlet thereof; none of these aforementioned patents, either alone or in combination with each other, recognizes or teaches a solution of the problems recognized and resolved by the inventive method and apparatus as is disclosed in this application.

The present invention recognizing past limitations in manufacture, assembly, installation and performance of prior furnace assemblies and in methods for heating gases and liquids, teaches a new and unexpected method and apparatus which considerably surmounts past limitations in the heat exchange art, providing a readily and economically manufactured, assembled, installed, maintained and repaired or replaced heat exchange system and parts thereof, the inventive system being capable of producing high and efficient performance over a broad range of turn-up and turn-down operating conditions. More specifically, the present invention provides a highly efficient, very compact heat exchange system which allows for operation at comparatively higher velocities and pressures to entrain and purge the system of corrosive condensation and other combustion outfalls, the arrangement of the present invention providing extremely high heat transfer efficiencies in a comparatively and considerably smaller equipment space with minimum standby losses. Further, the present invention provides a novel furnace assembly and method of operation which obtains a high ignition rate of reaction with a comparatively inexpensive venting system that reduces construction and insulation costs, avoids roll out of flame or gas, avoids undesirable chimney effects and minimizes standby losses. In addition, the method and apparatus of the present invention is readily adaptable to a large range of construction and processing environments with a capability of operating efficiently and quietly in a minimum of space and with a minimum of safety hazards due to a sealed pressure vessel combustion chamber arrangement.

Various other features of the present invention will become obvious to one skilled in the art upon reading the disclosure set forth herein.

SUMMARY OF THE INVENTION

More particularly, the present invention provides an improved process for heating fluids comprising: compressing a combustible fuel gas to a preselected pressure level in a first compression zone; compressing a combustion supporting gas to a preselected pressure level in a second compression zone; passing the compressed gases from the first and second compression zones through an injection and mixing zone having entrance and exit sections in a preselected manner to thoroughly mix the compressed gases; passing the mixture of compressed gases through a combustion zone having entrance and exit sections, igniting the mixture while therein; passing the products of combustion from the combustion zone through a heat exchange zone wherein the products are progressively contracted from inlet to outlet to increase the velocity thereof; passing a fluid to be heated thereby through the heat exchange zone in heat exchange relation therewith; and, exhausting the contracted products of combustion from the heat exchange zone. In addition, the present invention provides an improved structural arrangement for heating fluids comprising: a first compressor means having the suction side thereof in communication with a combustible fuel gas source; a second compressor means having the suction side thereof in communication with a combustion supporting gas source; a fluid heating assembly including an injection and mixing chamber having an entrance and exit section and a combustion chamber having an entrance and exit section, the entrance section of the injection and mixing chamber communicating with the first and second compressor means to receive combustible fuel gas and combustion supporting gas respectively therefrom under pressure and thoroughly mix the gases and the entrance section of the combustion chamber communicating with the exit section of the injection and mixing chamber to receive the thoroughly mixed gases therefrom; an ignition means disposed in the combustion chamber to ignite the mixed fuels; and, a heat exchanger conduit having the inlet end thereof communicating with the exit end of the combustion chamber to receive the products of combustion therefrom and the outlet end exhausting the products, the heat exchanger conduit narrowing progressively in cross-sectional area from inlet to outlet end thereof to contract and increase the velocity of the heated products of combustion passing therethrough. In addition, the present invention provides a novel arrangement for injection and mixing two fluids; a novel combustion arrangement along with a fluid reversing arrangement; and, a novel heat exchanger arrangement.

It is to be understood that various changes can be made by one skilled in the art in one or more of the several parts of the apparatus disclosed herein and in one or more of the several steps of the method disclosed herein without departing from the scope or spirit of this invention.

BRIEF DESCRIPTION OF THE DRAWINGS

Referring to the drawings which disclose an advantageous embodiment of the present invention:

Referring to FIG. 1 of the drawings, the broad schematic arrangement 2 is disclosed as including a combustible fuel gas source 3 and a separate combustion supporting gas source 4. Advantageously, fuel gas source 3 can be natural gas taken at the usual established 0.25 psig pressure from a conventional natural gas line used in everyday commercial, industrial and domestic practices. Combustion supporting gas 4 can be ambient air which can advantageously, if desired, be enriched with oxygen to enhance combustion. Any one of several known arrangements can be utilized for oxygen enrichment of air and details of such oxygen enrichment are not disclosed herein. Natural gas source 3 is connected to compressor 6 through conduit 7 and the combustion supporting air source 4 is connected to compressor 8 through conduit 9. Compressors 6 and 8 can be any one of a number of suitable, commercially available gas compressors and, advantageously, it has been found desirable to use commercially available hermetically sealed refrigerant compressors of a similar type for both the natural gas and the combustion supporting air.

Figure 1:
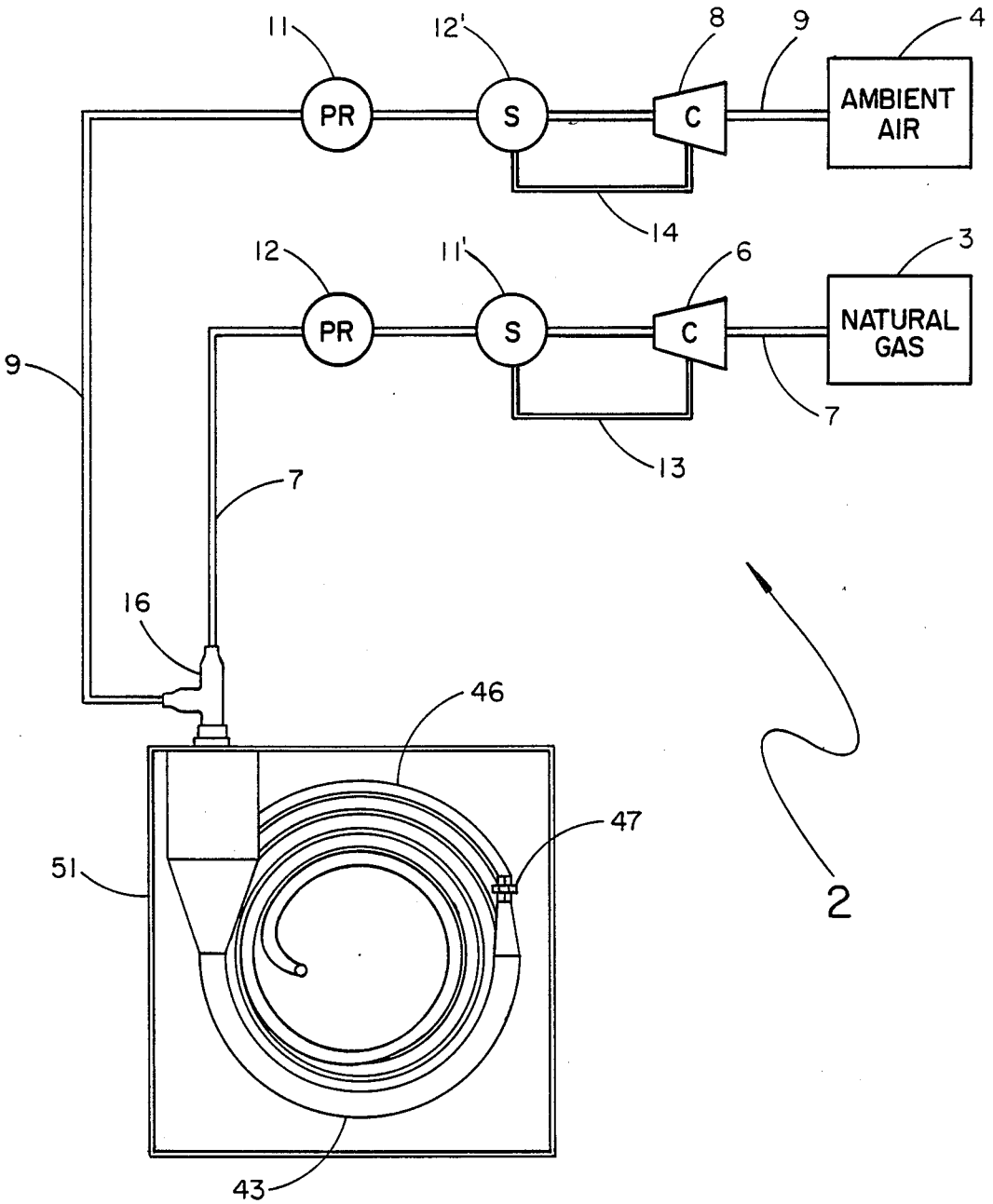
FIG. 1 is a flow diagram of the inventive method and apparatus, disclosing schematically one possible arrangement of the several parts of the invention.

Positioned downstream from each compressor 6 and 8 in lines 7 and 9 respectively is one of a pair of pressure regulators 11, 12, each pressure regulator being provided upstream thereof with an appropriate lubricator extractor 11', 12' having an appropriate recirculation line 13, 14 respectively to recirculate to the compressors lost lubricant. From the compressors 6 and 8, lines 7 and 9 lead to a novel injection and mixing chamber arrangement broadly referred to by reference numeral 16 in FIG. 1, such chamber serving to inject and mix gases for combustion prior to their introduction into a combustion chamber.

Figure 2:
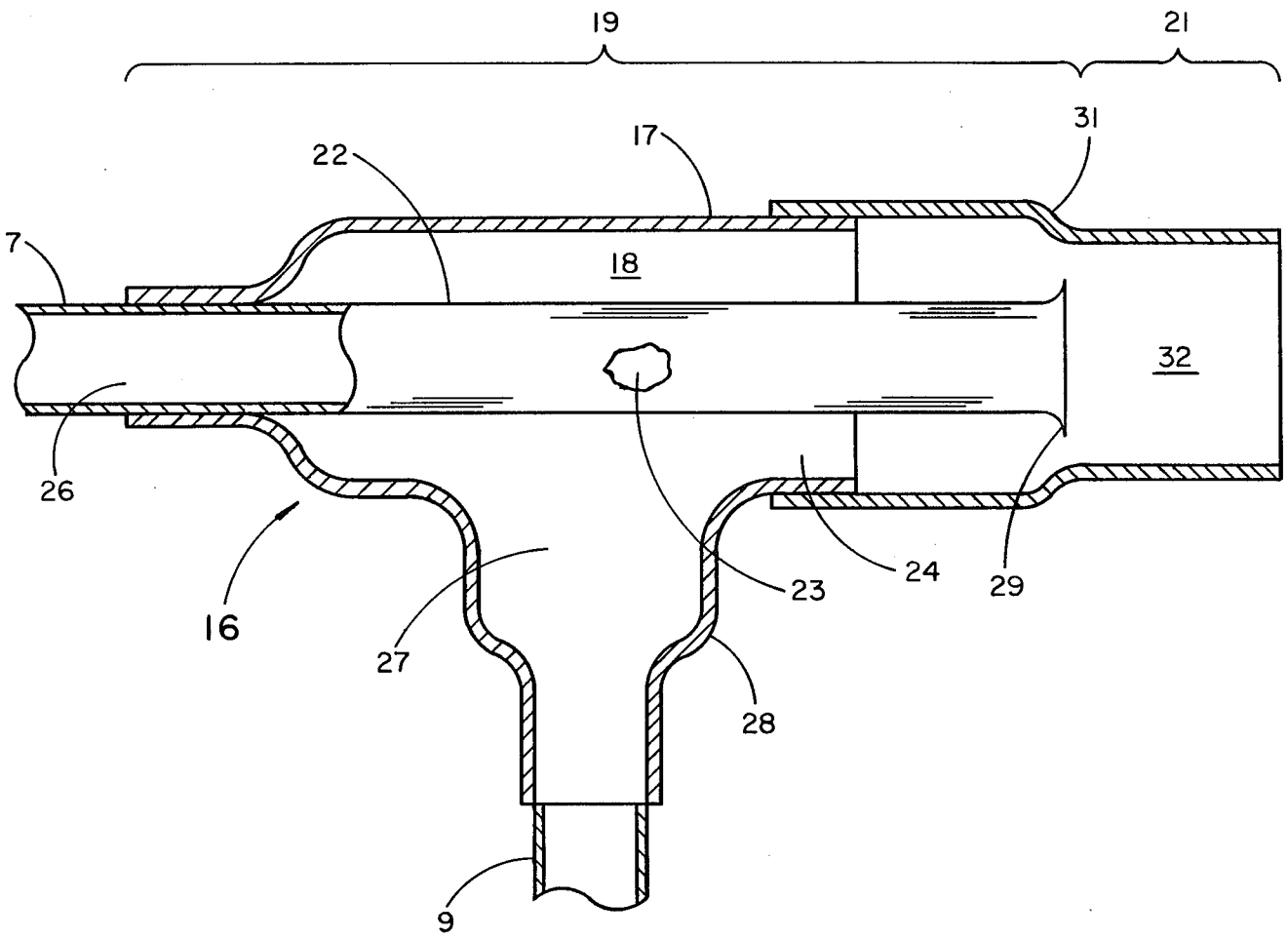
FIG. 2 is a greatly enlarged cross-sectional view of the novel injection and mixing arrangement which can be used to carry out the present invention.

Referring to FIG. 2 of the drawings, injection and mixing chamber 16 includes a main tubular conduit 17. Conduit 17 can be of a suitable material, such as a copper alloy or brass material and serves to define main tubular plenum chamber 18. The main tubular conduit includes an upstream entrance section, the lineal extent of which is indicated by bracket 19 and a downstream exit section, the lineal extent of which is indicated by bracket 21. A coaxial, centrally disposed tubular conduit 22 of smaller crosssectional area than main tubular conduit 17 and advantageously of equal cross-section to the aforedescribed conduit 7 to which it is connected, or which, if desired, can be a continuation of conduit 7, is centrally positioned in the entrance section of main plenum chamber 18 to extend along substantially the entirety of entrance section 19 in spaced relation to main tubular conduit 17. Conduit 22 also can be formed from a suitable material such as copper alloy or bass material. With the spacing between conduit 17 and conduit 22 extending therein, the main plenum chamber 18 defined by conduit 17 is divided into two subchambers in the entrance section 19 thereof. One such subchamber, as indicated by reference number 23 is annularly surrounded by the other, as indicated by reference number 24. Each subchamber, namely surrounded subchamber 23 and surrounding subchamber 24, is provided with an upstream gas inlet. Gas inlet 26 for surrounded subchamber 23, as previously described, is connected to conduit 7 (FIG. 1) leading from compressor 3. Gas inlet 27 for annular surrounding subchamber 24 is connected to conduit 9 leading from compressor 4 through a T-section connection joint 28, which joint 28 progressively widens from conduit 9 to gas inlet 27.

Figure 3:
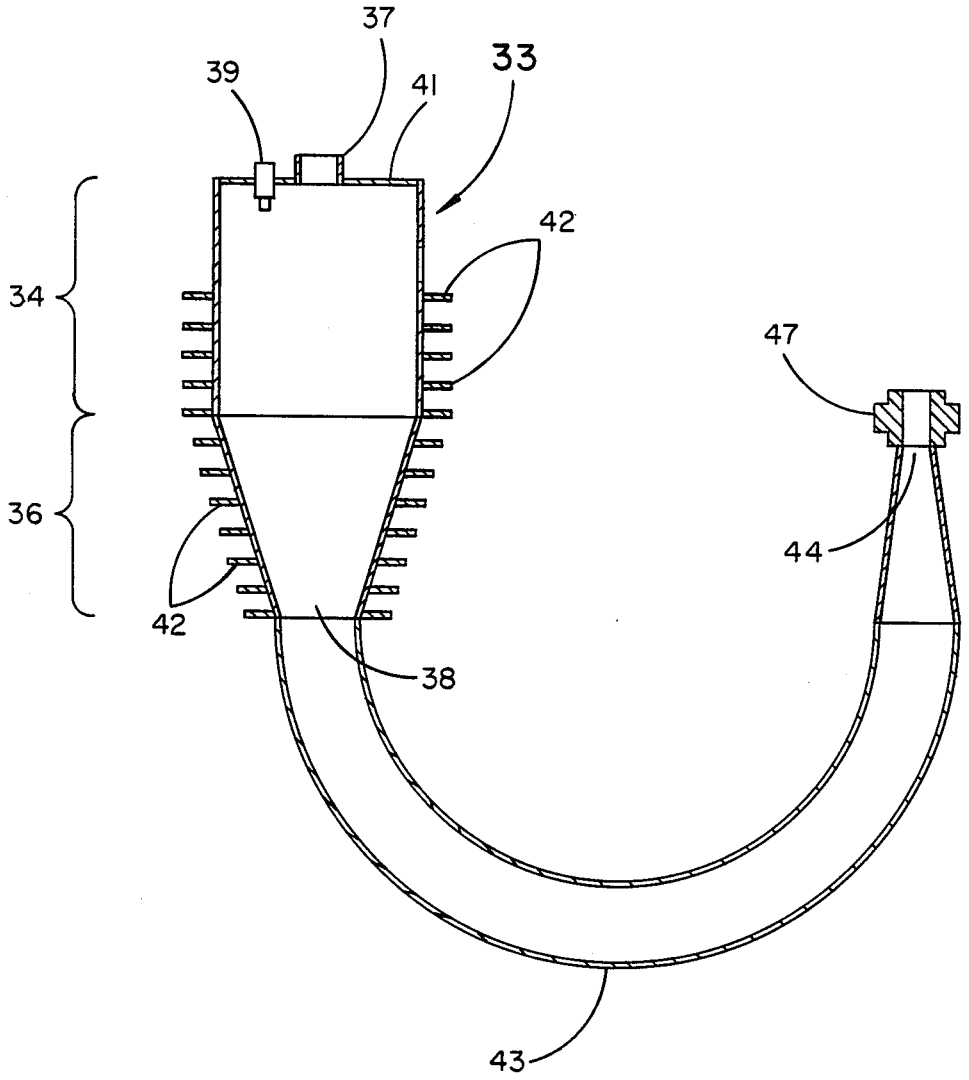
FIG. 3, when compared with FIG. 2, is a somewhat reduced cross-sectional view of the novel combustion chamber arrangement which can be used to carry out the present invention.

Referring specifically to the downstream end of entrance section 19, it is to be noted that surrounded tubular conduit 22 widens or progressively flares outwardly at 29 to provide an outwardly flared or progressively expanding outlet for surrounded central subchamber 23. It further is to be noted that main conduit 17 at the downstream end of entrance section 19 progressively narrows or is necked at this downstream end, as indicated by reference numeral 31 so as to progressively narrow annular subchamber 24 at the outlet end thereof. It also is to be noted that these outlets for the two subchambers fall substantially in the same plane adjacent the upstream inlet of the exit section 21 of main conduit 17. This exit section comprises the mixing chamber 32 for gases received from the two subchambers 23 and 24 with the gas received from central or surrounded subchamber 23 expanding and the gas received from surrounding subchamber 24 being increased in velocity at and beyond the common inlet face of mixing chamber 32, resulting in thorough gas mixing of the gas streams from the subchambers prior to introduction into combustion chamber 33 (FIGS. 1 and 3). It is to be understood that in accordance with the present invention it would also be possible to reverse the expansion and contraction of the subchamber outlets in accordance with usage of the subchambers and the mixing results desired.

Referring particularly to FIG. 3 of the drawings, combustion chamber 33, which can be formed from a suitable material, such as a mild steel material and appropriately lined with a compatible refractory material, also includes an upstream entrance section, the lineal extent of which is indicated by bracket 34 and a downstream exit section, the lineal extent of which is indicated by bracket 36. Combustion chamber 33 can be tubular in cross-section throughout from inlet end 37 of entrance section 34 to outlet end 38 of exit section 36. Exit section 36 advantageously is of frustum form to progressively narrow in cross-sectional diameter, approximately fifty (50) percent from upstream to the outlet of the exit section. Further, it is to be noted that the central lineal axis of exit section 36 comprises approximately fifty (50) percent of the overall central lineal axis of combustion chamber 33. Inlet end 37, which is connected to the outlet end of the mixing section 32 of injection and mixing chamber 16, advantageously has proximately positioned thereto a suitable igniter, such as a spark plug igniter 39 mounted in the back plate 41 of combustion chamber 33. As is generally known in the art, spark plug igniter 39 can be connected by wires to a suitable source of electrical energy (not disclosed).

As can also be seen in FIG. 3 of the drawings, suitably spaced annular fin members 42 can be integral with or appropriately fastened, such as by welding along the entirety of the outer periphery of tubular combustion chamber 33 on both entrance section 34 and exit section 36 to conduct heat from the combustion chamber and to augment heat exchange with a fluid stream, particularly when the novel heat exchanger coil described hereinafter is proximately spaced from the chamber 33.

As can be seen in FIG. 3, a suitable U-shaped or semicircular tube 43 can be sized to be connected at one end to outlet end 38 of combustion chamber 33. The outlet end 44 of tube 43 which progressively narrows in tapered fashion can be connected to a coiled heat exchanger 46 by a suitable connecting union 47. The U-tube 43 serves to reverse the flow path of the products of combustion emanating at increased velocities from combustion chamber 33 due to the narrowing of exit section 36. This reversal of the flow path can be approximately 180° to place both combustion chamber 33 and heat exchanger coil or conduit 46 in heat exchange relation with fluids to be heated (FIGS. 1, 4 and 5).

Figure 4:
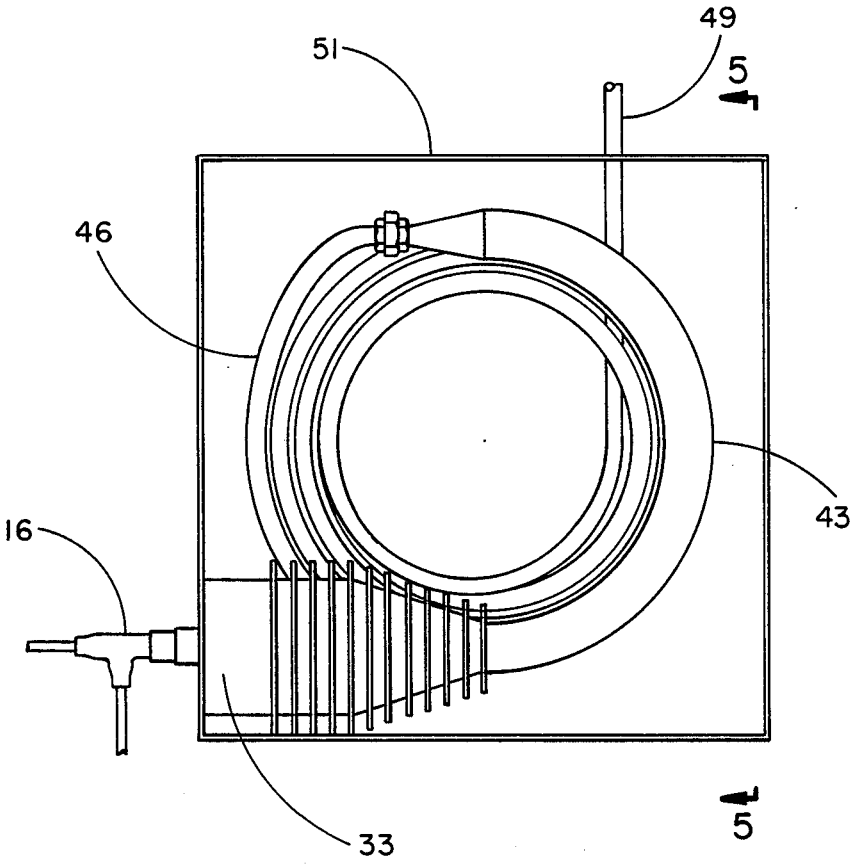
FIG. 4 is a cross-sectional side view of the novel combustion chamber and heat exchanger arrangement used in carrying out the present invention; and, FIG. 5 is an end view of the combustion chamber and heat exchanger of FIG. 4 taken in a plane through 5—5 of FIG. 4, disclosing one manner such heat exchanger and combustion chamber can be incorporated in a housing in heat exchange relation with a fluid stream to be heated.
Figure 5:
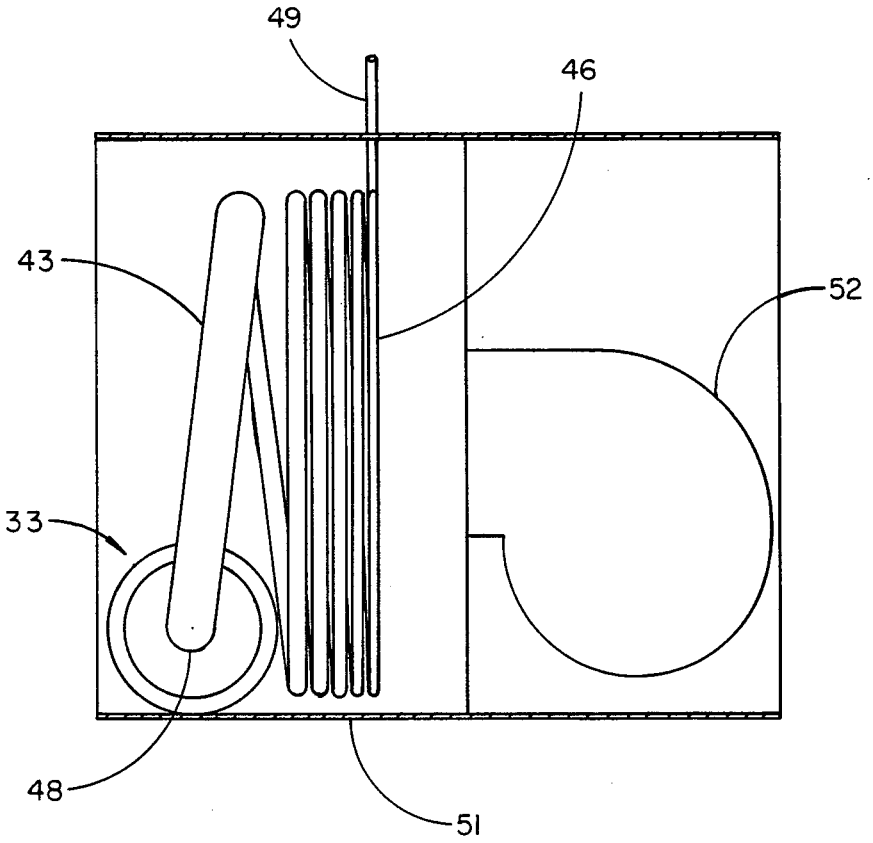

As can be seen more fully in FIGS. 4 and 5 of the drawings, heat exchange coil 46 can be formed in the geometric configuration of a helix. The heat exchanger coil 46 can be of a suitable heat conductive material, such as steel alloys, aluminum or ceramic materials and in accordance with one feature of the present invention, progressively narrows in diameter and thus cross-section from inlet 48 to outlet 49 with the cross-sectional area reduction from inlet to outlet being as much or even more than ninety (90) percent. It is to be noted that both combustion chamber 33 and heat exchanger coil 46 can be readily disposed in a flow-through housing 51 containing a suitable circulation blower 52 upstream thereof to move a gas stream, such as air, through and around heat exchange coil 46 and around the finned combustion chamber 33 and thus raise the gas stream temperature to a preselected and controlled level. In this regard, it is to be understood that, instead of a flow-through housing 51, the sealed combustor 33 and coil 46 or just the coil 46 can be disposed in a totally submerged condition in a flow through liquid chamber, such as a water boiler or a chemical distillation chamber, to raise the heat of liquid fluid therein with two or more units being usable because of compactness to provide rapid heat to the liquid fluid.

As above described, one of the unique features of the present invention is the compactness of the several parts of the inventive arrangement and the adaptability to usage of parts which are commercially available. For example, as above discussed, the compressors 6 and 8 can be of the hermetically sealed refrigerant type, with capabilities of raising combustion gas pressures such as natural gas from a conventional 0.25 psig and ambient air from a conventional 15 psia to as high or even higher than sixty (60) psig. The conduits in the system, such as conduits 7 and 9, can be of a conventional material, such as a copper-type alloy, with external diameters in the range of one-quarter ($\frac{1}{4}$) inch to one-half ($\frac{1}{2}$) of n inch. The pressure regulators, such as regulators 11 and 12, can be any one of several types of regulators known in the art, as can be the lubricant separators 11', 12' to separate lubricant for recirculation back to the compressors through by-pass conduits 13 and 14.

In the fluid heater assembly, the novel injection and mixing chamber 16 can be formed from conventional material, such as metal or ceramic tubing, with a surprisingly and comparatively small overall main chamber conduit 17 length of less than three (3) inches, advantageously two and eleven-sixteenth (2 11/16) inches, with an inner diameter of main plenum chamber 18 being eleven-sixteenths (11/16) of an inch along the upstream entrance section 19 and nine-sixteenths (9/16) of an inch along the downstream exit or mixing section 21. The tubular conduit 22 which can extend within main conduit 17 for approximately two and one-quarter ($2\frac{1}{4}$) inches of its length can have an outer diameter of one-quarter ($\frac{1}{4}$) of an inch, flared at ts outlet end to a five-sixteenths (5/16) outer diameter. The T-section joining conduit 9 with main conduit 17 can be five-sixteenths (5/16) of an inch at the inlet opening to a bell shape of nine-sixteenths of an inch and further flaring to join main conduit 17.

The tubular combustion chamber 33 which as above noted can be formed from mild steel, can be of less than eight (8) inches in length with the entrance section 34 having an approximate four (4) inch length and an internal diameter of three and one-half ($3\frac{1}{2}$) inches therealong. The exit section, which can be approximately three and one-half ($3\frac{1}{2}$) inches in length narrows from a three and one-half ($3\frac{1}{2}$) inch inlet diameter to a one and one-fourth ($1\frac{1}{4}$) inches outlet diameter to connect with U-tube 43 of similar one and one-fourth ($1\frac{1}{4}$) inch diameter at such connecting end. The U-tube which is turned 180° on a twelve (12) inch outer diameter radius has the last two inches tapering from one and one-fourth ($1\frac{1}{4}$) inch diameter to a five-eighths ($\frac{5}{8}$) inch diameter to connect with helix-like heat exchanger coil 46. Coil 46 can narrow from an internal diameter of five-eighths ($\frac{5}{8}$) of an inch at the inlet down to three-sixteenths (3/16) of an inch at its outlet within a fifteen (15) inch diameter housing 51 and even further thereafter. The tapering can be progressively continuous or in steps of five-eighths ($\frac{5}{8}$) inch tubing of two turns in a row, four-eighths (4/8) inch tubing of six turns in a row and three-eighths ($\frac{3}{8}$) inch tubing with five turns in a row with the three-eighths ($\frac{3}{8}$) inch tubing row being the most proximate to circulation blower 52 outlet. The exit tubing from the housing can be two-eighths (2/8) inch tubing and can be further coiled in the center of the helix to further enhance heat exchange.

In carrying out the inventive method taught herein, a combustible fuel gas such as natural gas at an initial pressure of approximately 0.25 pound per square inch gauge (psig) having a firing rate in the approximate range of ten thousand (10,000) to sixty thousand (60,000) BTUH and a flow rate of ten (10) cubic feet per hour to sixty (60) cubic feet per hour can be introduced into a hermetically sealed compression zone wherein the pressure of the gas is raised to an approximate pressure rate of ten (10) to sixty (60) pounds per square inch gauge (psig). At the same time, a sufficient air volume to allow stoichiometric combustion can be introduced into another hermetically sealed compression zone wherein the pressure of the air is raised to an approximate similar range of ten (10) to sixty (60) pounds per square inch. If desired, ten percent or greater excess air at an approximate velocity range of one hundred ten (110) cubic feet per hour to six hundred sixty (660) cubic feet per hour can also be employed above stoichiometric combustion, but it has been found that the efficiency effects of such excess air have been nominal. Further, if desired, the air can be oxygen enriched by some suitable arrangement (not disclosed) prior to compression to enhance efficiency. The compressed gas and air from the combustion zones can be regulated through pressure regulation zones with an advantageous turn-down, turn-up ratio of three (3) to one (1). Advantageously, the firing rate can be in the turn-down, turn-up range of ten thousand (10,000) to thirty thousand (30,000) BTUH and preferably held at approximately twenty thousand (20,000) BTUH. It is to be understood, however, that both the operational range and the turndown, turn-up ranges above described can be both below and above those stated, depending upon required demands and the concomitant size and capacity of equipment employed. In accordance with the present invention, when the compressed gases are regulated in the pressure regulation zones, the lubricants in the gases are separated therefrom and recirculated to the compression zones.

From the pressure regulating zones, the regulated compressed gases having a heat release ability in the approximate range of four hundred thousand (400,000) to two million five hundred thousand (2,500,000) BTUH/cu.ft. are then passed to an injection and mixing zone having entrance and exit sections to flow in separate coaxial linear streams along the entrance section of the zone with the compressed combustion supporting air stream annularly surrounding the compressed natural fuel gas stream until reaching the exit section of the zone wherein the compressed fuel gas is expanded with velocities in the approximate range of ten and one-half (10.5) to sixty three and four-tenths (63.4) feet per second and the combustion supported air stream is contracted to increase the velocity thereof with velocities in the approximate range of thirty-one and nine-tenths (31.9) to one hundred and ninety-one and four-tenths (191.4) feet per second with the mixed gases having a velocity in the approximate range of forty two and four-tenths (42.4) feet per second to two hundred seventy-four (274) feet per second and a pressure in the approximate range of seven (7) to twenty-three (23) psig.

The mixed gases are subsequently passed to a compression zone having entrance and exit sections with flow rates being in the approximate range of 0.0305 to 0.183 cubic feet per second wherein the mixture of compressed gases is ignited upstream the entrance section of the combustion zone before passing as products of combustion to the exit section of the combustion zone, the gases being contracted approximately fifty (50) percent between the upstream and downstream extremities of the exit section of the combustion zone. The direction of flow of the products of combustion emanating from the exit section of the combustion zone can then be reversed in a reversing zone to pass proximate the combustion zone to improve greater heat exchange relation with the accompaniment of the combustion zone. The products of combustion are passed from the reversing zone to a heat exchange zone proximate the combustion zone at least in part with the flow passage following the path of a helix and with the products of combustion in the heat exchange zone being progressively contracted in excess of at least ninety (90) percent from inlet to outlet of the heat exchange zone to thus increase the velocity of these products of combustion and to further entrain liquid condensations therefrom. In the heat exchange zone, a fluid-gas or liquid is passed in heat exchange relation with the products of combustions which are then exhausted, along with entrained condensations to ambient.

The velocities of the products in the entrance section of the combustion zone have been calculated to be in the approximate range for stoichiometric air input of 10,000 BTUH to be 0.536 feet per sec. to 3.21 feet per sec. for stioichiometric air input of 60,000 BTUH. Gas velocity calculations for stoichiometric air measured in the input range of 10,000 BTUH to 60,000 BTUH and with the cross-sectional area diminishing in the last four inches of the contracting exit section of a combustion zone are as set forth in Tables "A" and "B" below:

TABLE A

| Stoichiometric - 10,000 BTUH input | |
|---|---|
| Distance From Chamber Inlet End | Velocity |
| 4.5 inches | 0.6277 feet per sec. |
| 5.0 inches | 0.7574 feet per sec. |
| 5.5 inches | 0.9290 feet per sec. |
| 6.0 inches | 1.1680 feet per sec. |
| 6.5 inches | 1.1530 feet per sec. |
| 7.0 inches | 2.0370 feet per sec. |
| 7.5 inches | 2.8900 feet per sec. |
| 8.0 inches | 4.4150 feet per sec. |

TABLE B

| Stoichiometric - 60,000 BTUH input | |
|---|---|
| Distance From Chamber Inlet End | Velocity |
| 4.5 inches | 3.766 feet per sec. |
| 5.0 inches | 4.538 feet per sec. |
| 5.5 inches | 5.574 feet per sec. |
| 6.0 inches | 7.009 feet per sec. |
| 6.5 inches | 9.080 feet per sec. |
| 7.0 inches | 12.226 feet per sec. |
| 7.5 inches | 17.340 feet per sec. |
| 8.0 inches | 26.491 feet per sec. |

In addition, gas velocity calculations for air with stoichiometric input ranges of 12,980; 21,845; and 30,130 BTUH, calculated for nineteen selected substantially equally spaced positions extending sequentially from inlet end to outlet end along the approximatley thirty-five (35) linear foot length of the narrowing heat exchange zone are as set forth in Table "C" below:

TABLE C

| Position Along Ht. Ex. Zone | Velocity ft/sec 12,980 BTUH | Velocity ft/sec 21,845 BTUH | Velocity ft/sec 30,130 BTUH |
|---|---|---|---|
| 1 | 5.74 | 9.67 | 13.34 |
| 4–6 | 13.08 | 27.56 | 42.85 |
| 7 | 9.37 | 20.29 | 32.37 |
| 8 | 9.43 | 20.61 | 32.04 |
| 9–10 | 33.55 | 75.96 | 117.91 |
| 11 | 22.56 | 46.15 | 70.03 |
| 12 | 35.27 | 66.00 | 98.90 |
| 13 | 34.62 | 62.24 | 90.11 |
| 14 | 33.53 | 60.01 | 85.52 |
| 15 | 33.00 | 60.01 | 85.92 |
| 16 | 32.72 | 59.39 | 85.35 |
| 17 | 31.75 | 58.46 | 84.19 |
| 18 | 58.56 | 106.38 | 153.07 |
| 19 | 58.31 | 104.40 | 149.78 |

From the above Table "C", given a few aberrant calculating results, it can readily be seen that as the heat exchange zone narrows and as the BTUH input increases, the velocity of the products of combustion flowing through the heat exchange zone increases substantially in applicants, inventive arrangement, assuring the carrying away of condensation and undesireable containants.

Thus, a highly efficent, compact heat exchange system operating at high velocities and pressures is provided by the inventive arrangement described above.

The invention claimed is:

1. An improved flow through process for heating fluids comprising:

compressing a combustible fuel gas to a preselected pressure level in a first compression zone;

compressing a combustion supporting gas to a preselected pressure level in a second compression zone;

passing said compressed gases from said first and second compression zones through an injection and mixing zone having entrance and exit sections in a preselected manner to throughly mix said compressed gases;

passing said mixture of compressed gases through a combustion zone having entrance and exit sections, igniting the mixture while therein;

passing said products of combustion from said combustion zone through a heat exchange zone wherein said products are progressively contracted from inlet to outlet to increase the velocity thereof;

passing a fluid to be heated through said heat exchange zone in flow-through heat exchange relation therewith; and, exhausting said contracted products of combustion directly to ambient from said heat exchange zone.

2. The fluid heating process of claim 1, said combustible fuel gas being a natural gas and said combustion supporting gas being oxygen enriched.

3. The fluid heating process of claim 1, and regulating the pressure level of said gases between said compression zones and said injection and mixing zone.

4. The fluid heating process of claim 1, said compressed gases being passed through said injection and mixing zone flowing in separate linear streams along said entrance section of said zone until reaching said exit section of said zone wherein one of said gas streams is expanded and the other gas stream is contracted to increase the velocity thereof resulting in through mixing of said streams prior to introduction into said combustion zone.

5. The fluid heating process of claim 1, said compressed gases being passed through said injection and mixing zone to flow in separate coaxial linear streams along said entrance section of said zone with one gas stream annularly surrounding the other stream until reaching said exit section of said zone wherein one of said gas streams is expanded and the other gas stream is contracted to increase the velocity thereof resulting in thorough mixing of said streams prior to introduction into said combustion zone.

6. The fluid heating process of claim 1, said compressed gases being passed through said injection and mixing zone to flow in separate coaxial linear streams along said entrance section of said zone with said compressed combustion supporting gas stream annularly surrounding said compressed combustible fuel gas stream until reaching said exit section of said zone wherein said compressed combustible fuel gas is expanded and said compressed combustion supporting gas is contracted to increase the velocity thereof resulting in thorough mixing of said streams prior to introduction into said combustion zone.

7. The fluid heating process of claim 1, wherein said mixture of compressed gases is ignited upstream said entrance section of said combustion zone.

8. The fluid heating process of claim 1, wherein said mixture of compressed gases is ignited upstream said entrance section of said combustion zones before passing to said exit section of said combustion zone, said gases being contracted approximately fifty (50) percent between the upstream and downstream extremities of said exit section of said combustion zone.

9. The fluid heating process of claim 1, said mixture of gases being turned approximately 180° after passing through said exit section of said combustion zone before entering said heat exchange zone.

10. The fluid heating process of claim 1, said gases being progressively contracted in said heat exchange zone to follow the path of a helix while in said heat exchange zone.

11. The fluid heating process of claim 1, said combustible fuel gas being introduced into said process at a rate n the approximate range of ten (10) cubic feet per hour to sixty (60) cubic feet per hour and said combustion supporting gas being introduced into said process at a rate in the approximate range of one hundred (100) cubic feet per hour to six hundred and sixty (660) cubic feet per hour to produce a firing rate in the range of approximately ten thousand (10,000) to sixty thousand (60,000) BTU per hour and a heat release in the approximate range of 400,000 to 2,500,000 BTU per hour/cu.ft.

12. The fluid heating process of claim 1, said mixed gases at said exit section of said injection and mixing zone having a velocity in the approximate range of forty-two and four-tenths (42.4) feet per second to two hundred and seventy-four (274.0) feet per second and a pressure in the approximate range of seven (7) to twenty-three (23) pounds per square inch gauge.

13. In a fluid heating process wherein combustible fuel gas is mixed with a combustion supporting gas at preselected pressure levels for passing through a combustion zone for ignition and burning, an improved process for injecting and mixing said gases in an injection zone having entrance and exit sections, comprising passing said gases to flow in separate linear streams along said entrance section of said zone until reaching said exit section of said injection and mixing zone wherein one of said gas streams is expanded and the other gas stream is contracted to increase the velocity thereof resulting in thorough mixing of said streams in said exit zone prior to passing through said combustion zone.

14. In a fluid heating process wherein combustible fuel gas is mixed with a combustion supporting gas at preselected pressure levels for introduction to a combustion zone for ignition and burning, an improved process for injecting and mixing said gases in an injection and mixing zone having entrance and exit sections, comprising passing said gases to flow in separate coaxial, linear streams along said entrance section of said zone with one gas stream annularly surrounding the other stream until reaching said exit section of said zone wherein one of said gas streams is expanded and the other gas stream is contracted to increase the velocity thereof resulting in thorough mixing of said streams prior to passage through said combustion zone.

15. In a fluid heating process wherein combustible fuel gas is mixed with a combustion supporting gas at preselected pressure levels for introduction to a combustion zone for ignition and burning, an improved process for injecting and mixing said gases in an injection and mixing zone having upstream flow entrance and downstream exit mixing section, comprising passing said gases to flow in separate coaxial linear streams along said entrance section of said zone with said compressed combustion supporting gas stream annularly surrounding said compressed combustible fuel gas stream until reaching said exit section of said zone wherein said compressed fuel gas is expanded and said compressed combustion supporting gas is contracted to increase the velocity thereof resulting in thorough mixing of said streams prior to passage through said combustion zone.

16. A flow through fluid heating process wherien combustible fuel gas is mixed with a combustion supporting gas at preselected pressure levels for passing through a combustion zone having an entrance and exit section for ignition and burning an improved process for combustion said gases in the combustion zone comprising:

igniting said mixed gases at the upstream entrance section of said combustion zone;

passing said ignited gases to said exit section; and, contracting said gases approximately fifty (50) percent between the upstream and downstream extremities of said exit section.

17. In a flow through fluid heating process wherein combustible fuel gas is mixed with a combustion supporting gas at preselected presusre levels and subsequently passed through a combustion zone with the products of combustion then being passed to a heat exchange zone, an improved heat exchange process comprising:

contracting said products or combustion progressively from inlet to outlet of said heat exchange zone as they are passed therethrough to increase the velocity thereof and to entrain liquid condensation therein;

passing a fluid to be heated through said heat exchange zone in heat exchange relation therewith; and, exhausting said contracted products of combustion and liquid condensations from said heat exchange zone directly to ambient.

18. The process of claim 17, wherein said products of combustion are passed through said heat exchange zone in a helical path.

19. The process of claim 17, wherein said products of combustion are contracted in said heat exchange zone in excess of fifty (50) percent from inlet to outlet of said zone.

20. The process of claim 17 wherein the flow of said products of combustion emanating from said combustion zone is reversed in direction approximately 180° in a reversing zone before passing to said heat exchange zone to improve heat exchange relation with said combustion zone.

21. The process of claim 17 wherein said products of combustion and condensate emanating from said heat exchange zone are exhausted to ambient.

22. The process of claim 17, wherein said fluid to be heated which is passed through said heat exchange zone in heat exchange relation therewith is an air stream.

23. The process of claim 17, wherein said fluid to be heated which is passed through said heat exchange zone in heat exchange relation therewith is water.

24. In a flow through fluid heating process wherein combustible fuel gas is mixed with a combustion supporting gas at preselected pressure levels and subsequently introduced into a combustion zone with the products of combustion thne being passed to a heat exchange zone, an improved heat exchange process comprising:

reversing the direction of flow of the products of combustion emanting from said combustion zone approximately 180° in a reversing zone to pass proximate said combustion zone to improve heat exchange relation with said combustion zone;

passing said products of combustion form said reversing zone to a heat exchange zone proximate at least in part said combustion zone with the flow passage following the past of a helix and said heat exchange zone contracting the products of combustion progressive in excess of at least fifty (50) percent from inlet to outlet of said heat exchange zone to increase the velocity of said products of combustion and to further entrain liquid condensation therefrom;

passing a fluid to be heated along said heat exchange zone in heat exchange relation therewith; and, exhausting said contracted products of combustion and liquid condensations from said heat exchange zone directly to ambient.

25. An improved process for heating fluids comprising:

compressing a combustible natural fuel gas flowing within a range of ten (10) cubic feet per hour to sixty (60) cubic feet per hour in an hermetically sealed compression zone to a pressure in the range of approximately ten (10) to sixty (60) pounds per square inch gauge (psig);

compressing an oxygen enriched combustion supporting gas such as air flowing within a range of one hundred (100) cubic feet per hour to six hundred and sixty (660) cubic feet per hour in an hermetically sealed compression zone to a comparable pressure in the range of approximately ten (10) to sixty (60) pounds per square inch gauge (psig);

regulating the pressure level of said gases after said compression zone while separating and recirculating liquids to said compression zones;

passing said compressed gases capable of producing a firing rate in the range of approximately ten thousand (10,000) to sixty thousand (60,000) BTU per hour and a heat release in the approximate range of four hundred thousand (400,000) to two million five hundred thousand (2,500,000) BTU per hour per cubic foot through an injection and mixing zone having entrance and exit sections to flow in separate coaxial linear streams along said entrance section of said zone with said compressed combustion supporting air stream annularly surrounding said compressed natural fuel gas stream until reaching said exit section of said zone wherein said compressed natural fuel gas is expanded and said compressed combustion supporting air stream is contracted to increase the velocity thereof with said mixed gases having a velocity in the approximate range of forty-two and four-tenths (42.4) feet per second to two hundred and seventy-four (274.0) feet per second and a pressure in the approximate range of seven (7) to twenty-three (23) pounds per square inch gauge;

passing said mixture of compressed gases through a combustion zone having entrance and exit sections wherein said mixture of compressed gases are ignited upstream said entrance section of said combustion zone before passing to said exit section of said combustion zone, said gases being contracted approximately fifty (50) percent between the upstream and downstream extremities of said exit section of said combustion zone;

reversing the direction of flow of the products of combustion emanating from said combustion zone approximately 180° in a reversing zone to pass proximate said combustion zone to improve heat exchange relation with the accompaniment of said combustion zone;

passing said products of combustion from said reversing zone to a heat exchange zone proximate at least in part to said combustion zone to flow in the path of a helix and with the products of combustion in said heat exchange zone being progressively contracted in excess of at least ninety (90) percent from inlet to outlet of said heat exchange zone to increase the velocity of said products of combustion and to further entrain liquid condensation therefrom;

passing a fluid to be treated along said heat exchange zone in heat exchange relation therewith; and, exhausting said contracted products of combustion and liquid condensations centrally from said heat exchange zone to ambient.

26. An improved structural flow through arrangement for heating fluids comprising:

a first compressor means having the suction side thereof in communication with a combustible fuel gas source;

a second compressor means having the suction side thereof in communication with a combustion supporting gas source;

a fluid heating assembly including an injection and mixing chamber having an entrance and exit section and a combustion chamber having an entrance and exit section, said entrance section of said injection and mixing chamber communicating with said first and second compressor means to receive combustible fuel gas and combustion supporting gas respectively therefrom under pressure and to pass them to said exit section to throughly mix said gases and said entrance section of said combustion chamber communicating with said exit section of said injection and mixing chamber to receive said throughly mixed gases therefrom;

an ignition means disposed in said combustion chamber to ignite said mixed fuels; and, a heat exchanger conduit having the inlet end thereof communicating with said exit end of said combustion chamber to receive the heated products of combustion therefrom and the outlet end exhausting said products to ambient, said heat exchanger conduit narrowing progressively in cross-sectional area from inlet to outlet end thereof to contract and increase the velocity of hte heated products of combustion pasisng therethrough to ambient.

27. The structural arrangement for heating fluids of claim 26 wherein said combustible fuel gas source is a natural gas and said combustible supporting gas source is an oxygen enriched air source.

28. The structural arrangement for heating fluids of claim 26 wherein a cooperative pressure regulating means is positioned downstream each of said first and second compressor means before said injection and mixing chamber, each pressure regulating means having positioned upstream thereof means to recycle compressor lubricant to the compressor means with which it cooperates.

29. The structural arrangement for heating fluids of claim 26 wherein said injection and mixing chamber comprises a main plenum chamber housing including said entrance and exit sections;

a dividing wall member disposed in said entrance section of said main plenum chamber housing to provide two subchambers therein, each having a gas inlet adjacent the upstream end thereof in communication with one of said compressor means so that the pressurized gas streams from each of said first and second compressor means flow in separate parallel linear streams through said subchambers, one of said subchambers having an outwardly flared downstream outlet and the other subchamber having a narrowing downstream outlet, both outlets being positioned adjacent the upstream inlet of said exit section of said main plenum housing whereby one gas stream is expanded in said exit section and the other contracted to increase the velocity thereof resulting in thorough mixing of said gas streams prior to introduction into said combustion chamber.

30. The structural arrangement for heating fluids of claim 26, wherein said injection and mixing chamber comprises a first tubular main plenum chamber conduit defining said entrance and exit sections;

a second tubular conduit disposed in said entrance section of said tubular main plenum chamber conduit in spaced relation therewith to provide two subchambers in said entrance section of said tubular main plenum conduit, one of which annularly surrounds the others, each subchamber having a gas inlet adjacent the upstream end thereof in communication with one of said compressor means so that the pressurized gas stream from each of said first and second compressor means flows in separate coaxial parallel linear streams along said entrance section with one gas stream annularly surrounding the other, one of said tubular conduits having an outwardly flared downstream outlet and the other a narrowing downstream outlet, both downstream outlets being positioned adjacent the upstream inlet of said exit section of said first main tubular conduit whereby one gas stream is expanded in said exit section and the other contracted to increase the velocity thereof resulting in thorough mixing of said gas streams prior to introduction into said combustion chamber.

31. The structural arrangement for heating fluids of claim 26 wherein said injection and mixing chamber comprises a first tubular conduit defining a main plenum chamber including said entrance and exit sections;

a second tubular conduit disposed in said entrance section of said tubular plenum chamber conduit in spaced relation therewith to provide two subchambers in said entrance section of said tubular main plenum conduit, one of which annularly surrounds the other, each subchamber having a gas inlet adjacent the upstream end thereof in communication with one of said compressor means, said annular subchamber gas inlet being in the form of a T-section joint progressively widening at said inlet and in communication with said compressor for combustion supporting gas and said surrounded subchamber gas inlet being in communication with said compressor for combustion fuel gas, said surrounded subchamber having an outwardly flared downstream outlet and said annular surrounding subchamber outlet progressively narrowing, both said downstream outlets being positioned in the same plane adjacent the upstream inlet of said exit section of said first main tubular conduit whereby the combustion fuel gas from said surrounded subchamber is expanded and the combustion supporting gas from said surrounding subchamber is increased in velocity resulting in thorough gas mixing of said gas streams prior to introduction into said combustion chamber.

32. The structural arrangement for heating fluids of claim 26, said combustion chamber having a spark plug igniter means adjacent the upstream inlet end of said entrance section.

33. The structural arrangement for heating fluids of claim 26, said combustion chamber entrance section being tubular in crosssection from inlet to outlet thereof and said exit section being of frustum form progressively narrowing from inlet to outlet with its central axis comprising approximately fifty (50) percent of the overall central axis of said combustion chamber.

34. The structural arrangement for heating fluids of claim 26, said combustion chamber being refractory lined and having spaced heat exchange fins extending from the outer periphery thereof.

35. The structural arrangement for heating fluids of claim 26, and a U-tube having one end connected to said exit section of said combustion chamber and the opposite end thereof connected to said inlet end of said heat exchanger conduit to reverse the flow path of the products of combustion approximately 180° and place both combustion chamber and heat exchange conduit in the path of heating fluids to be treated.

36. The structural arrangement for heating fluids of claim 26, said heat exchanger conduit progressively narrowing in cross-section from inlet to outlet thereof and being in the form of a helical coil.

37. The structural arrangement for heating fluids of claim 26, said heat exchanger conduit comprising a plurality of joined stepdown sections, each of narrower cross-section than the upstream section to which it is joined, said joined sections being in the form of a helical coil surrounding in spaced relation therefrom at least a portion of said combustion chamber.

38. The structural arrangement for heating fluids of claim 26, said heat exchanger conduit progressively narrowing in cross-section from inlet to outlet thereof in excess of ninety (90) percent reduction.

39. An improved structural arrangement for heating fluids comprising:

a first hermetically sealed compressor having the suction side thereof in communication with a combustible natural fuel gas source;

a second hermetically sealed compressor having the suction side thereof in communication with a combustion supporting oxygen enriched gas source;

a pair of pressure regulating control valves, each connected downstream to one of said compressors and including means to recycle lubricant to its regulated compressor;

a furnace assembly including an injection and mixing chamber having an entrance and exit section and a combustion chamber having an entrance and exit section, said entrance section of said injection and mixing chamber communicating with said first and second compressors to receive the compressed natural fuel gas and oxygen enriched air therefrom and thoroughly mix the same and said entrance section of said combustion chamber communicating with said exit section of said injection and mixing chamber to receive said thoroughly mixed gases therefrom;

said injection and mixing chamber including a first tubular conduit defining a main plenum chamber including said entrance and exit sections and a second tubular conduit disposed in said entrance section of said first tubular conduit in spaced relation therewith to provide two subchambers in said entrance section of said first tubular conduit, one of which subchambers annularly surrounds the other subchamber with each subchamber having a gas inlet adjacent the upstream end thereof with said gas inlet for said annular subchamber being in the form of a T-section joint progressively widening at said inlet and in communication with said compressor for oxygen enriched air and with said surrounded subchamber gas inlet in communication with said compressor for natural fuel gas, said surrounded subchamber having an outwardly flared downstream outlet and said annular surrounding subchamber outlet progressively narrowing, both said downstream outlets of said subchambers being positioned adjacent the upstream inlet of said exit section of said first conduit whereby the natural gas from said surrounded subchamber is expanded and the oxygen enriched supporting air from said surrounding subchamber is increased in velocity resulting in thorough gas mixing of said gas streams prior to introduction into said combustion chamber;

said combustion chamber being refractory lined and having spaced heat exchange fins extending from the outer periphery thereof with said entrance section having a spark plug igniter means adjacent the upstream inlet end of said entrance section, said combustion chamber being tubular in cross-section throughout from inlet to outlet thereof with said exit section being of frustum form to progressively narrow in cross-sectional diameter approximately fifty (50) percent from inlet to outlet with the central axis of said exit section comprising approximately fifty (50) percent of the overall central axis of said combustion chamber;

a U-tube having one end connected to said exit section of said combustion chamber and the opposite end connected to said inlet end of said heat exchanger conduit to reverse the flow path of the products of combustion approximately 180° and place both combustion chamber and heat exchange conduit in the path of fluids to be heated;

said heat exchanger conduit comprising a plurality of joined step-down sections, each of narrower cross-sections than the upstream section to which it is joined, said joined sections being in the form of a helical coil surrounding in spaced relation therefrom at least a portion of said combustion chamber with the last outlet section of said heat exchanger conduit being centrally positioned with respect to said helix and exhausting to ambient.

40. The apparatus of claim 39, at least said heat exchange coil being disposed in a flow-through housing through which an air stream to be heated is passed in heat exchange relation therewith.

41. The apparatus of claim 39, at least said heat exchange coil being disposed in a flow-through boiler housing through which water to be heated is passed in heat exchange relation therewith.

42. An injection and mixing chamber for a combustor chamber of a furnace assembly comprising a main plenum chamber housing defining entrance and exit sections;

a dividing wall member disposed in said entrance section of said main plenum chamber housing to provide two subchambers therein each having a gas inlet adjacent the upstream end thereof in communication with one of two pressurized gas streams so that said gas streams flow in separate parallel linear streams through said subchambers, one of said subchambers having an outwardly flared downstream outlet and the other subchamber having a narrowing downstream outlet, both outlets being positioned adjacent the upstream inlet of said exit section of said main plenum housing whereby one gas stream is expanded in said exit section and the other contracted to increase the velocity thereof resulting in thorough mixing of said gas streams prior to introduction into said combustion chamber.

43. The injection and mixing chamber of claim 42, wherein said injection and mixing chamber includes a first tubular main plenum chamber conduit defining said entrance and exit sections;

a second tubular conduit disposed in said entrance section of said tubular main plenum chamber conduit in spaced relation therewith to provide two subchambers in said entrance section of said tubular main plenum conduit, one of which annularly surrounds the others, each subchamber having a gas inlet adjacent the upstream end thereof in communication with one of said compressor means so that said pressurized gas streams flow in separate coaxial parallel linear streams along said entrance section with one gas stream annularly surrounding the other, one of said tubular conduits having an outwardly flared downstream outlet and the other a narrowing downstream outlet, both downstream outlets being positioned adjacent the upstream inlet of said exit section of said first main tubular conduit whereby one gas stream is expanded in said exit section and the other contracted to increase the velocity thereof resulting in thorough mixing of said gas streams prior to introduction into said combustion chamber.

44. The injection and mixing chamber of claim 42 wherein said injection and mixing chamber includes a first tubular main plenum chamber conduit defining said entrance and exit sections;

a second tubular conduit disposed in said entrance section of said tubular plenum chamber conduit in spaced relation therewith to provide two subchambers in said entrance section of said tubular main plenum conduit, one of which annularly surrounds the other, each subchamber having a gas inlet adjacent the upstream end thereof in communication with one of said gas streams, said annular subchamber gas inlet being in the form of a T-section joint progressively widening at said inlet and in communication with said compressor for combustion supporting gas and said surrounded subchamber gas inlet being in communication with said compressor for combustion fuel gas, said surrounded subchamber having an outwardly flared downstream outlet and said annular surrounding subchamber outlet progressively narrowing, both said downstream outlets being positioned adjacent the upstream inlet of said exit section of said first main tubular conduit whereby the combustion fuel gas from said surrounded subchamber is expanded and the combustion supporting gas from said surrounding subchamber is increased in velocity resulting in thorough gas mixing of said gas stream prior to introduction into said combustion chamber.

45. A combustion chamber for a flow through furnace assembly exhausting directly to ambient, said combustion chamber including entrance and exit sections; said combustion chamber entrance section being tubular of similar cross-section from inlet to outlet thereof and said exit section being of frustrum form progressively and uniformly narrowing from inlet to outlet thereof with its central axis comprising approximately fifty (50) percent of the overall central axis of said combustion chamber to contract products of combustion from said entrance section of said combustion chamber approximatley fifty (50) percent from inlet to outlet of said exit section with a minimum of flow turbulence.

46. The combustion chamber of claim 45, said combustion chamber being refractory lined and having spaced heat exchange fins extending from the outer periphery thereof in both said entrance and exit sections.

47. A combustion chamber and heat exchanger conduit for a flow through surface assembly exhausting direclty to ambient including a U-tube having one end connected directly to said comubstion chamber outlet and the opposite end thereof connected directly to said inlet end of said heat exhanger conduit to promptly reverse the flow path of the products of combustion emanating from said combustion chamber approximately 180° and place both combustion chamber and heat exchange conduit compactly in the path of heating fluid to be treated.

48. A heat exchanger conduit for a combuster chamber of a furnace assembly exhausting directly to ambient, said heat exchanger conduit profressively narrowing in cross-section from inlet to ambient outlet thereof and being in the form of an encased, compact helical coil open at said inlet and said ambient outlet and being continously enclosed therebetween to provide a continously narrowing helical passage extending compactly from said inlet to said ambient outlet.

49. The heat exchanger conduit of claim 48, said heat exchanger conduit comprising a plurality of joined step-down sections, each of narrower cross-section than the upstream section to which it is joined, said joined sections being in the form of a helical coil surrounding in spaced relation therefrom at least a portion of said combustion chamber.

50. The heat exchanger conduit of claim 48, said heat exchanger conduit progressively narrowing in cross-section from inlet to outlet thereof in excess of ninety (90) percent reduction.

* * * * *